US008215579B2

(12) United States Patent
Mizoro

(10) Patent No.: US 8,215,579 B2
(45) Date of Patent: Jul. 10, 2012

(54) PAPER SHEET STORING AND FEEDING UNIT

(75) Inventor: Tsuguo Mizoro, Hyogo (JP)

(73) Assignee: Glory Ltd., Himeji-Shi. Hyogo (JP)

( * ) Notice: Subject to any disclaimer, the term of this patent is extended or adjusted under 35 U.S.C. 154(b) by 257 days.

(21) Appl. No.: 12/660,889

(22) Filed: Mar. 5, 2010

(65) Prior Publication Data

US 2010/0163571 A1 Jul. 1, 2010

Related U.S. Application Data

(63) Continuation-in-part of application No. PCT/JP2007/070263, filed on Oct. 17, 2007.

(51) Int. Cl.
*B65H 39/14* (2006.01)

(52) U.S. Cl. ..... 242/528; 271/216

(58) Field of Classification Search ..... 242/528; 221/71; 270/60; 271/216
See application file for complete search history.

(56) References Cited

U.S. PATENT DOCUMENTS

| | | | | |
|---|---|---|---|---|
| 4,337,864 | A * | 7/1982 | McLean | 209/534 |
| 6,669,136 | B2 * | 12/2003 | Niioka et al. | 242/528 |
| 6,715,753 | B1 | 4/2004 | Conca et al. | |
| 6,969,064 | B2 * | 11/2005 | Ichikawa et al. | 271/216 |
| 7,845,573 | B2 * | 12/2010 | Peters et al. | 235/494 |
| 2011/0068528 | A1 * | 3/2011 | Kobayashi et al. | 270/58.07 |

FOREIGN PATENT DOCUMENTS

| | | |
|---|---|---|
| EP | 0 953 533 A1 | 11/1999 |
| EP | 1 772 406 A1 | 4/2007 |
| JP | 03-128854 | 5/1991 |
| JP | 11-272913 | 10/1999 |
| JP | 2000-123219 | 4/2000 |
| JP | 2001-266213 | 9/2001 |
| JP | 2006-069708 | 3/2006 |

OTHER PUBLICATIONS

International Search Report (2 pages—dated Dec. 11, 2007).
European Search Report corresponding to European Patent Application No. 07829997.1 (7 pages—dated Aug. 12, 2011).

* cited by examiner

*Primary Examiner* — Sang Kim
(74) *Attorney, Agent, or Firm* — Renner, Kenner, Greive, Bobak, Taylor & Weber

(57) ABSTRACT

The present invention is to provide a banknote storing and feeding unit 19 capable of increasing the maximum storage quantity of banknote 45 and stably storing and feeding banknote 45.

A first tape 36 and a second tape 37 are pressed by a tape pressing body 87 between first and second winding reels 38 and 39 and a winding drum 40 so as to come into contact with each other. Even the banknote 45 having a short length in a transporting direction is held between the first tape 36 and second tape 37 at a position of the tape pressing body 87 for transportation. An outer diameter of the winding drum 40 is detected by an outer diameter detecting unit 85, and the tape pressing body 87 is moved by a moving unit 92 in accordance with the detected outer diameter of the winding drum 40, and the tape pressing body 87 is moved to an appropriate position following a change in the outer diameter of the winding drum 40. Thus, the maximum storage quantity of the banknote 45 can be increased and the banknote 45 can be stably stored and fed.

9 Claims, 8 Drawing Sheets

PAPER SHEET STORING AND FEEDING UNIT

CROSS-REFERENCE TO RELATED APPLICATION

This application is a continuation-in-part of International Application No. PCT/JP2007/070263 filed Oct. 17, 2007 (now pending).

TECHNICAL FIELD

The present invention relates to a paper sheet storing and feeding unit which stores and feeds paper sheets by winding and unwinding tapes.

BACKGROUND ART

In a banknote processing machine such as a banknote depositing and dispensing machine for depositing and dispensing banknotes as paper sheets, for example, a tape storage type banknote storing and feeding unit using two tapes for storing and feeding banknotes has been conventionally used.

In the banknote storing and feeding unit, two tapes are used, one end side of the respective tapes is attached to two winding reels and wound around the reels, the other end side of the respective tapes, facing each other, is attached to one winding drum and wound around the drum. The respective tapes between the two winding reels and the winding drum are guided to the banknote depositing and dispensing position where transported banknotes are received or banknotes are deposited or dispensed by the guide rollers. Additionally, at a position coaxial to each of the guide rollers, a pair of transport rollers are disposed holding a banknote transported to the banknote depositing and dispensing position to send it to a space between the pair of tapes which are to be wound around the winding drum, and holding the banknote fed from between the pair of tapes, which are unwound from the winding drum to feed it from the banknote depositing and dispensing position.

When storing banknotes, a transported banknote is held between the transport rollers to send it to the space between the two tapes, the transported banknote by the transport rollers is wound and stored around the winding drum being held between the two tapes by winding the two tapes around the winding drum. When feeding banknotes, the two tapes are unwound from the winding drum, thereby feeding the banknote fed from between the two tapes being held by the transport rollers (see, for example, Patent Document 1).

Additionally, there is a banknote storing and feeding unit in which two tapes are largely folded into one by a pressing roller, which is provided in the vicinity of a winding drum, between the winding drum and guide rollers, and a banknote is held between the two tapes (see, for example, Patent Document 2).

Additionally, there is a banknote storing and feeding unit in which only one tape is used, and, by winding the tape around a winding drum, banknotes are sent into a space between an outer circumferential face of the winding drum and the tape which is to be wound around the winding drum for winding and storing. On the other hand, by unwinding the tape from the winding drum, banknotes are peeled off from the winding drum by a scraper coming into contact with the outer circumferential face of the winding drum for feeding. The scraper is provided swingably in accordance with an outer diameter of the winding drum around which the tape is wound, and a top end of the scraper is biased by a spring so as to constantly come into contact with the winding drum, and an auxiliary roller for holding a banknote between the scraper and the tape is provided integrally with a middle portion of the scraper (see, for example, Patent Document 3).

In such a banknote storing and feeding unit, the distance between a tape winding position of the winding drum and the transport rollers changes in accordance with the maximum storage quantity of banknotes. As the maximum storage quantity of banknotes increases, the outer diameter of the winding drum becomes large and the distance between the tape winding position of the winding drum and the transport rollers becomes long.

Thus, in the case of increasing the maximum storage quantity of banknotes more than conventionally, the distance between the tape winding position of the winding drum and the transport rollers becomes longer than the length in a transporting direction of a banknote. Thus, even if a banknote having a length in the transporting direction shorter than the distance between the tape winding position of the winding drum and the transport rollers is located between the two tapes, it is not held between the tape winding position of the winding drum and the transport rollers. Therefore, it is impossible to stably store and feed banknotes. That is, it is difficult for the conventional banknote storing and feeding unit to increase the maximum storage quantity of banknotes.

Additionally, there is a banknote storing and feeding unit in which two tapes are largely folded into one by a pressing roller provided in the vicinity of a winding drum between the winding drum and guide rollers to hold a banknote therebetween. However, since the pressing roller is fixed, the outer diameter of the winding drum is regulated, and it is difficult to increase the maximum storage quantity of banknotes. Further, since the tapes are largely folded by the pressing roller, a banknote is folded reversely to the winding direction of the winding drum and there is a possibility of causing trouble with the storage state of banknotes wound and stored around the winding drum, in the case of using tapes each having a width shorter than that of the banknote.

Additionally, there is a banknote storing and feeding unit using only one tape, in which a banknote is held between an auxiliary roller provided integrally with the middle portion of a scraper swingable in accordance with the outer diameter of the winding drum, the outer diameter of the winding drum capable of making both the scraper and auxiliary roller function has an appropriate range, and in the case where the outer diameter exceeds the appropriate range, the scraper and the auxiliary roller do not function, therefore, the outer diameter of the winding drum is regulated, thereby it is difficult to increase the maximum storage quantity of banknotes.

Patent Document 1: Japanese Laid-open Patent Publication No. 2006-69708 (pages 9-11, FIGS. 1 and 2)

Patent Document 2: Japanese Laid-open Patent Publication No. 3-128854 (page 2, FIG. 1)

Patent Document 3: Japanese Laid-open Patent Publication No. 2000-123219 (pages 3 and 4, FIGS. 1 and 2)

DISCLOSURE OF THE INVENTION

Problems to be Solved by the Invention

The present invention aims to provide a paper sheet storing and feeding unit for storing and feeding paper sheets by winding and unwinding tapes, wherein the maximum storage quantity of paper sheets can be increased and paper sheets can be stably stored and fed.

Means to Solve the Problems

A paper sheet storing and feeding unit according to claim 1 of the invention is a paper sheet storing and feeding unit for storing transported paper sheets and feeding stored paper sheets outward, and includes: a first tape; a second tape; a first winding reel to which one end of the first tape is attached and around which the first tape is wound and unwound; a second winding reel to which one end of the second tape is attached and around which the second tape is wound and unwound; a winding drum, to which other ends of the first and second tapes are attached so that at least a part of the first tape and a part of the second tape are overlapped when the first and second tapes are wound, and around which the first and second tapes and a paper sheet held between the first and second tapes are wound and unwound; a tape pressing body which is arranged between the first and second winding reels and the winding drum and presses the first and second tapes at least one place so as to bring the first and second tapes into contact with each other; an outer diameter detecting unit for detecting the outer diameter of the winding drum around which the paper sheet is wound; and a moving unit for moving the tape pressing body in accordance with the outer diameter of the winding drum detected by the outer diameter detecting unit.

The first tape and second tape are pressed by the tape pressing body so as to come into contact with each other between the first and second winding reels and the winding drum, thereby even a banknote having a small length in a transporting direction can be held between the first tape and second tape at a position of the tape pressing body and reliably transported. Additionally, the outer diameter of the winding drum is detected by the outer diameter detecting unit and the tape pressing body is moved by the moving unit in accordance with the detected outer diameter of the winding drum, thereby the tape pressing body can be moved to an appropriate position following a change in the outer diameter of the winding drum. Thus, the maximum storage quantity of paper sheets can be increased, and paper sheets can be stably stored and fed. Additionally, the tape pressing body is moved in accordance with the outer diameter of the winding drum, thereby the first and second tapes can be prevented from largely folding at the position of the tape pressing body, and troubles can be prevented from occurring in the storage state of banknotes wound and stored around the winding drum.

With a paper sheet storing and feeding unit according to claim 2 of the invention, in the paper sheet storing and feeding unit according to claim 1, at least one of the following guide units is included: a first guide unit which is pressed against the first tape between the tape pressing body and the first winding reel to guide the first tape so that the paper sheet is transported to a space between the first tape and the second tape; and a second guide unit which is pressed against the second tape between the tape pressing body and the second winding reel to guide the second tape so that the paper sheet is transported to the space between the first tape and the second tape.

The first and second tapes are guided by the first and second guide units and a paper sheet can be transported to the space between the first tape and the second tape, positions of the winding reels can be freely determined and compact design can be realized in accordance with conditions of set-up places.

With a paper sheet storing and feeding unit according to claim 3 of the invention, in the paper sheet storing and feeding unit according to claim 1, the outer diameter detecting unit includes a contact body which comes into contact with an outer circumferential face of the winding drum around which the paper sheet is wound and follows and moves in accordance with the outer diameter of the winding drum, and the moving unit includes an interlocking mechanism which moves the tape pressing body in accordance with movement of the contact body.

The tape pressing body is interlocked with the contact body, which follows and moves in accordance with the outer diameter of the winding drum via the interlocking mechanism, thereby the tape pressing body can be moved to an appropriate position by a simple constitution.

With a paper sheet storing and feeding unit according to claim 4 of the invention, in the paper sheet storing and feeding unit according to claim 1, the moving unit includes a driving unit for moving the tape pressing body in accordance with the outer diameter of the winding drum detected by the outer diameter detecting unit.

The tape pressing body can be moved to an appropriate position by the driving unit.

With a paper sheet storing and feeding unit according to claim 5 of the invention, in the paper sheet storing and feeding unit according to claim 1, the outer diameter detecting unit includes: a contact body which comes into contact with the outer circumferential face of the winding drum around which the paper sheet is wound and follows and moves in accordance with the outer diameter of the winding drum; and a contact body movement amount detecting unit for detecting a movement amount of the contact body, and the moving unit includes a driving unit for moving the tape pressing body in accordance with the movement amount of the contact body detected by the contact body movement amount detecting unit.

The movement amount of the contact body following and moving in accordance with the outer diameter of the winding drum is detected, thereby the tape pressing body can be moved to an appropriate position by the driving unit.

With a paper sheet storing and feeding unit according to claim 6 of the invention, in the paper sheet storing and feeding unit according to claim 1, the outer diameter detecting unit includes a non-contact detection sensor for detecting, without contact, the outer diameter of the winding drum around which the paper sheet is wound, and the moving unit includes a driving unit for moving the tape pressing body in accordance with the outer diameter of the winding drum detected by the non-contact detection sensor.

The outer diameter of the winding drum is detected by the non-contact detection sensor, thereby the tape pressing body can be moved to an appropriate position by the driving unit.

With a paper sheet storing and feeding unit according to claim 7 of the invention, in the paper sheet storing and feeding unit according to claim 1, the outer diameter detecting unit detects the winding quantity of the first and second tapes which are wound around the winding drum, and the moving unit includes a driving unit for moving the tape pressing body in accordance with the winding quantity of the first and second tapes which are wound around the winding drum detected by the outer diameter detecting unit.

The winding quantity of the first and second tapes which are wound around the winding drum is detected, thereby the outer diameter of the winding drum can be estimated and the tape pressing body can be moved to an appropriate position by the driving unit.

With a paper sheet storing and feeding unit according to claim 8 of the invention, in the paper sheet storing and feeding unit according to claim 1, the outer diameter detecting unit counts the number of paper sheets wound and stored around the winding drum, and the moving unit includes a driving unit for moving the tape pressing body in accordance with the storage number of paper sheets counted by the outer diameter detecting unit.

The paper sheets wound and stored around the winding drum are counted, thereby the outer diameter of the winding drum around which paper sheets are wound can be estimated and the tape pressing body can be moved to an appropriate position by the driving unit.

With a paper sheet storing and feeding unit according to claim 9 of the invention, in the paper sheet storing and feeding unit according to claim 1, the outer diameter detecting unit detects the rotation amount of at least either the winding drum or the winding reel, and the moving unit includes a driving unit for moving the tape pressing body in accordance with the rotation amount of at least either the winding drum or the winding reel detected by the outer diameter detecting unit.

The rotation amount of at least either the winding drum or the winding reel is detected, thereby the outer diameter of the winding drum around which paper sheets are wound can be estimated and the tape pressing body can be moved to an appropriate position by the driving unit.

Effects of the Invention

According to a paper sheet storing and feeding unit of the present invention, the maximum storage quantity of paper sheets can be increased and paper sheets can be stably stored and fed.

Figure 1:
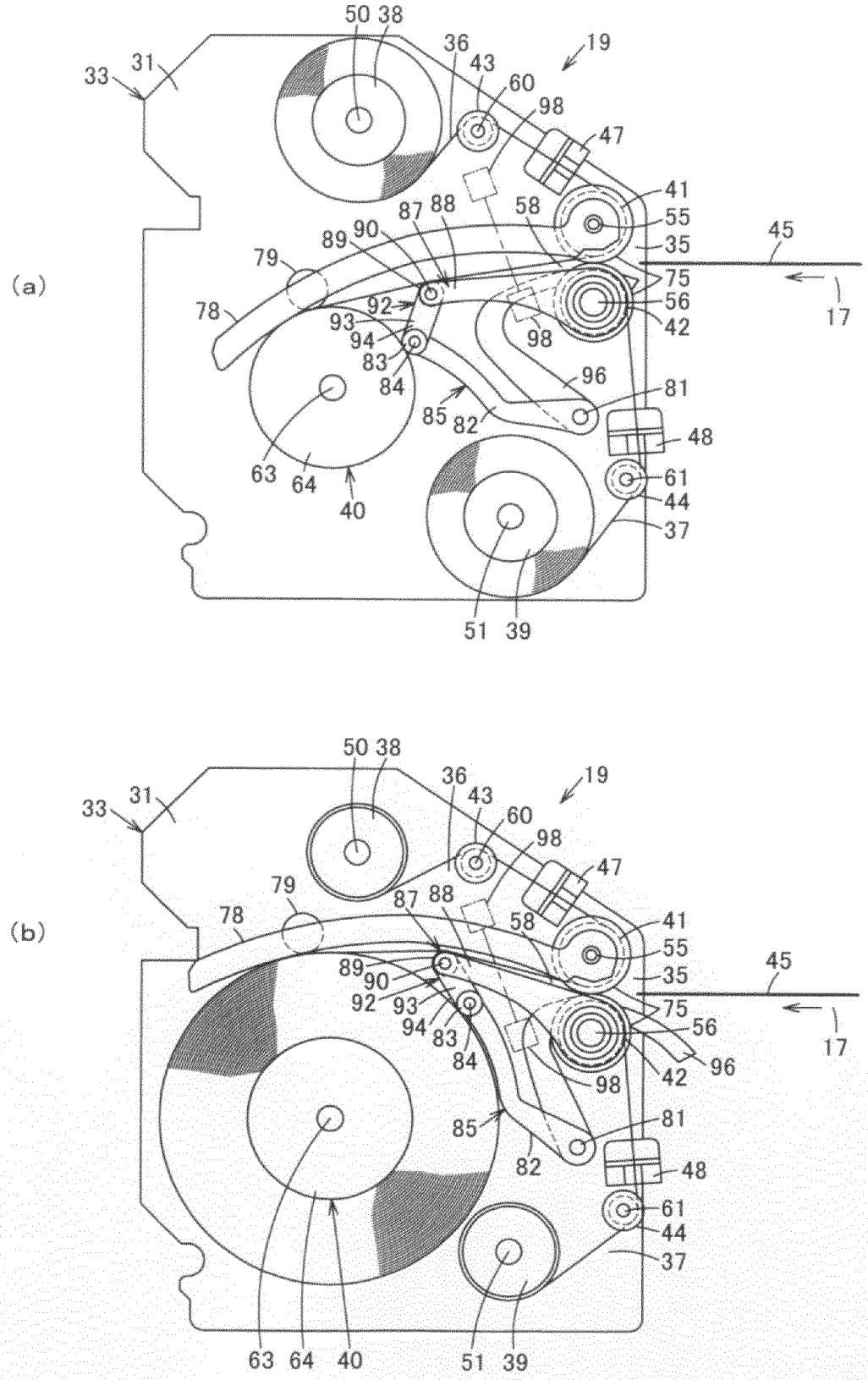
FIG. 1 is a cross sectional view of a paper sheet storing and feeding unit of a first embodiment of the present invention, FIG. 1(*a*) is a cross sectional view of the unit in which no paper sheets are stored, and FIG. 1(*b*) is a cross sectional view of the unit in which a maximum storage quantity of paper sheets are stored.
Figure 2:
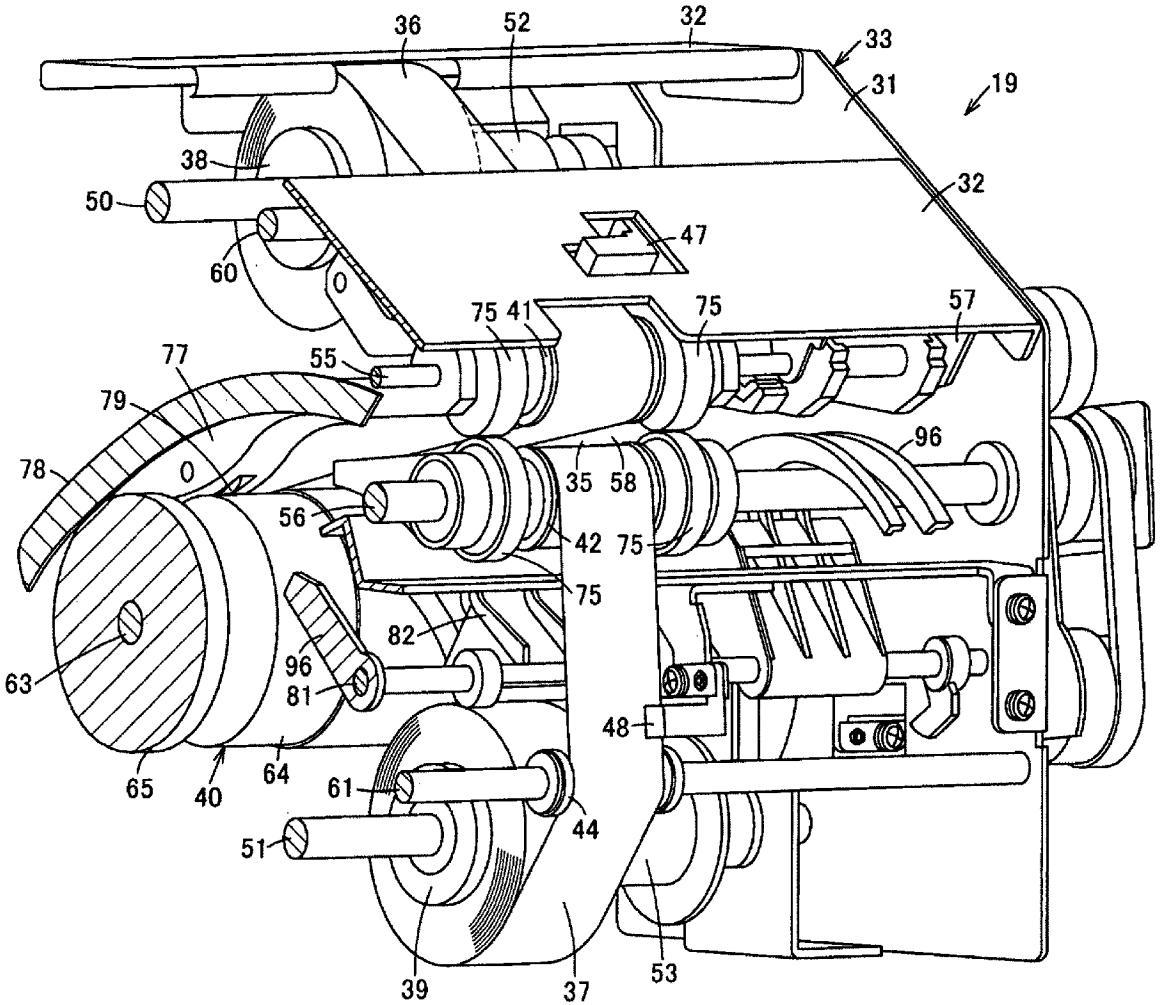
FIG. 2 is a perspective view showing the paper sheet storing and feeding unit a part of which is omitted.
Figure 3:
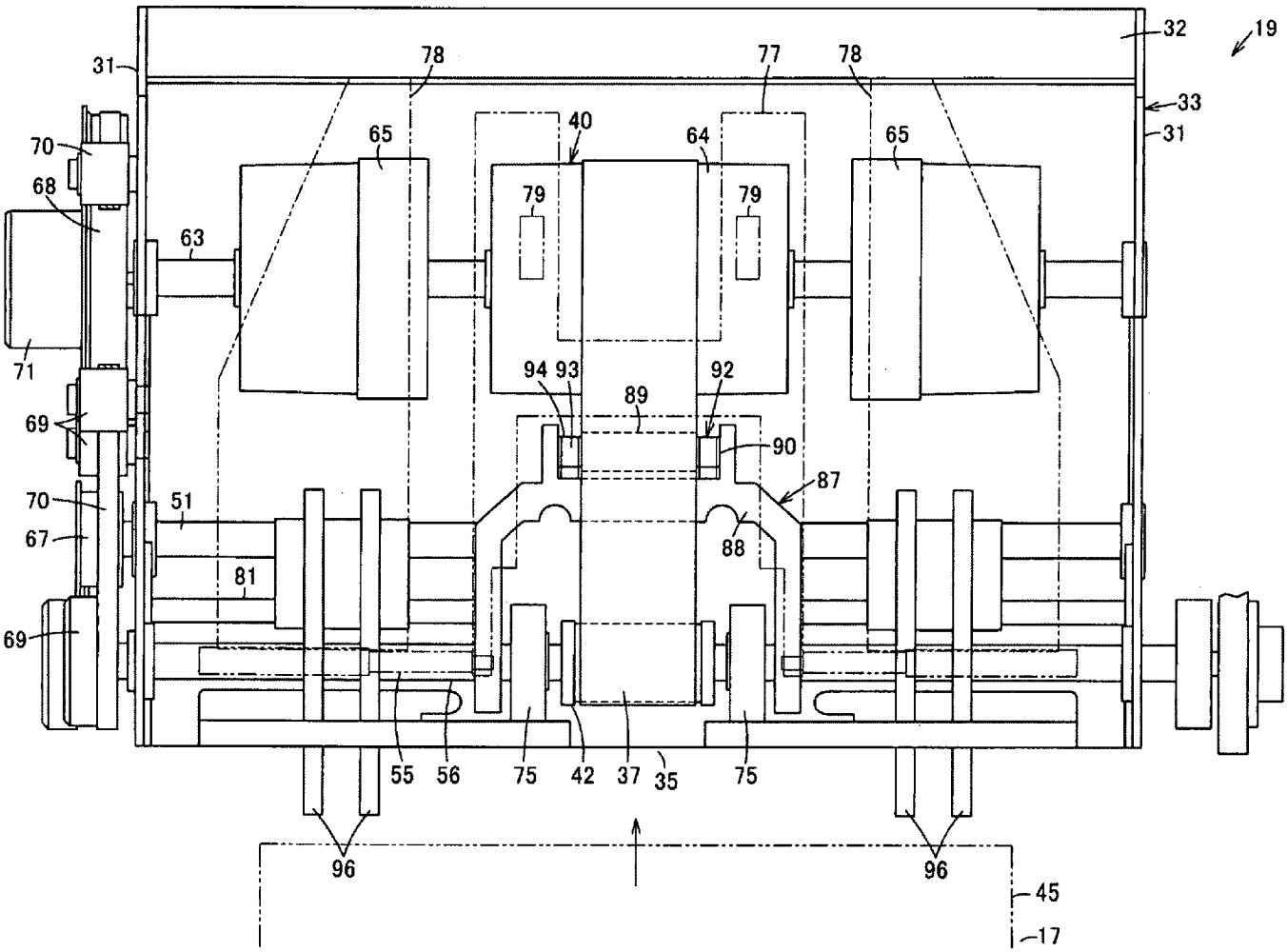
FIG. 3 is a plan view showing the paper sheet storing and feeding unit a part of which is omitted.

| REFERENCE NUMERALS | |
|---|---|
| 19 | Banknote storing and feeding unit as paper sheet storing and feeding unit |
| 36 | First tape |

-continued

| REFERENCE NUMERALS | |
|---|---|
| 37 | Second tape |
| 38 | First winding reel |
| 39 | Second winding reel |
| 40 | Winding drum |
| 41 | First guide roller as first guide unit |
| 42 | Second guide roller as second guide unit |
| 45 | Banknote as paper sheet |
| 83 | Contact roller as contact body |
| 85 | Outer diameter detecting unit |
| 87 | Tape pressing body |
| 92 | Moving unit |
| 94 | Interlocking mechanism |
| 101 | Contact body movement amount detecting unit |
| 102 | Driving unit |
| 108 | Non-contact detection sensor |

BEST MODE FOR CARRYING OUT THE INVENTION

Hereinafter, embodiments of the present invention will be described with reference to the drawings.

FIGS. 1 to 5 show a first embodiment.

Figure 5:
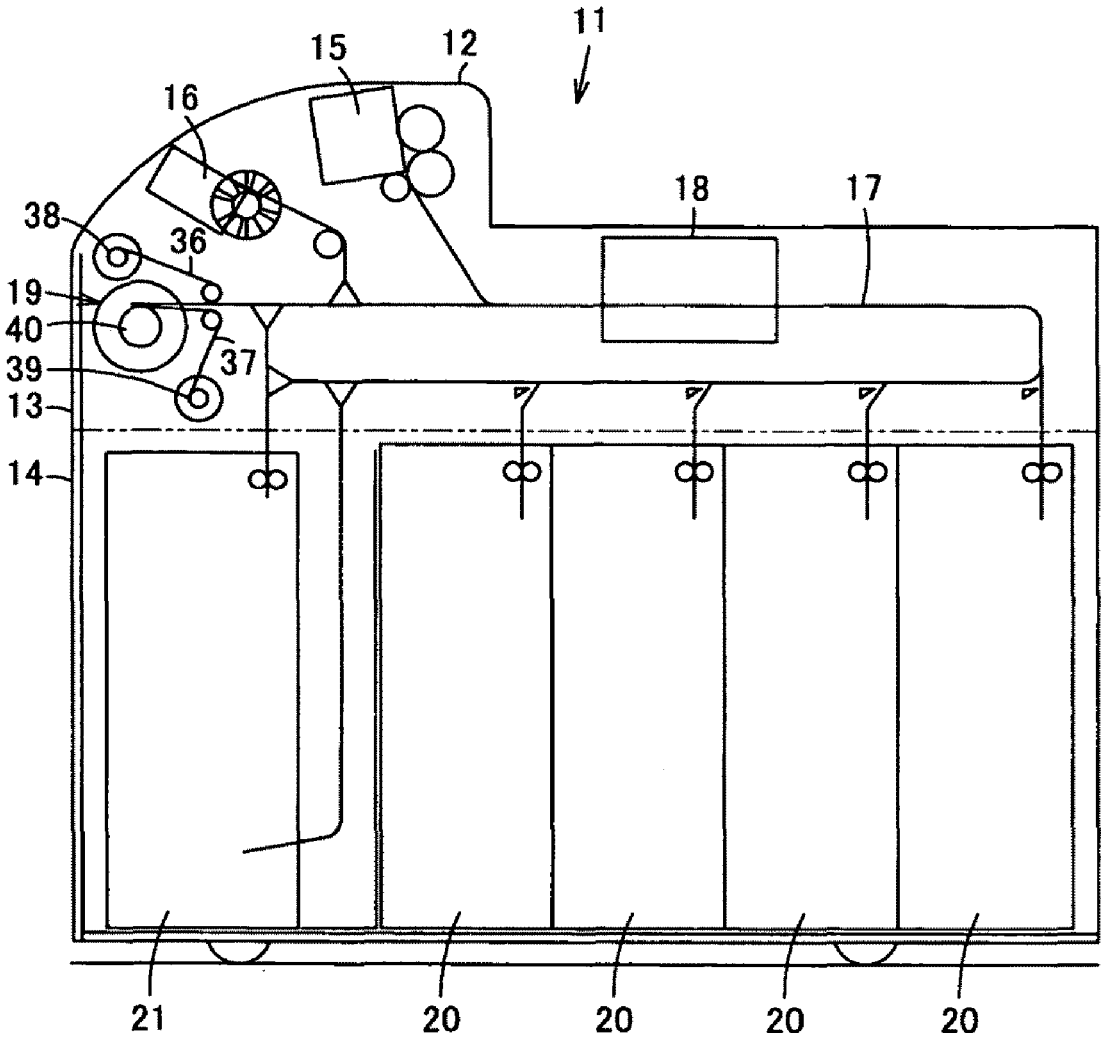
FIG. 5 is an explanatory view of a paper sheet processing machine using the paper sheet storing and feeding unit.

FIG. 5 shows a banknote processing machine as a paper sheet processing machine. A banknote processing machine 11 is a banknote depositing and dispensing machine for depositing and dispensing banknotes as paper sheets, and an upper block 13 and a lower block 14 capable of being drawn out from a machine body 12 are provided in the machine body 12.

In the upper block 13, there are disposed: an inlet 15 for depositing banknotes; an outlet 16 for dispensing banknotes; a transport path 17 for transporting banknotes; a recognition unit 18 for recognizing banknotes transported on the transport path 17; and a banknote storing and feeding unit 19 as a paper sheet storing and feeding unit which is an escrow unit for escrowing banknotes one by one in the separated state.

In the lower block 14, stackers 20 for storing banknotes for each denomination which are juxtaposed back and forth; and a cassette 21 for storing banknotes is arranged in front of the stackers 20.

A transporting direction of banknotes to be handled by the banknote processing machine 11 is a short-side direction orthogonal to a longitudinal direction of a banknote.

In a depositing process, banknotes put in the inlet 15 are sent one by one to the transport path 17, and recognized by the recognition unit 18. Banknotes recognized as normal by the recognition unit 18 are transported to the banknote storing and feeding unit 19 for escrowing. Additionally, when a storing instruction is issued after a process until escrow of banknotes put in the inlet 15 is completed, the banknotes escrowed in the banknote storing and feeding unit 19 are fed one by one to the transport path 17, recognized by the recognition unit 18, and then transported to the corresponding denomination-specific stackers 20 for storing. When a returning instruction is issued, the banknotes escrowed in the banknote storing and feeding unit 19 are fed one by one to the transport path 17, and transported to the outlet 16 for returning. On the other hand, in a dispensing process, banknotes stored in the stackers 20 of the corresponding dispensing denominations are fed one by one to the transport path 17 and recognized by the recognition unit 18, and banknotes recognized as normal are transported to the outlet 16 for dispensing.

Next, FIGS. 1 to 4 show the banknote storing and feeding unit 19. The banknote storing and feeding unit 19 includes a frame 33 having both side plates 31 and a connection member 32 for connecting these side plates 31.

Between both side plates 31 of the frame 33, there are disposed: a banknote depositing and dispensing port 35 as a paper sheet depositing and dispensing port facing the transport path 17; first and second winding reels 38 and 39 to which one end sides of a first tape 36 and a second tape 37 are attached for winding; a winding drum 40 to which the respective other end sides of the respective tapes 36 and 37 are attached for winding; a first guide roller 41 as a first guide unit and a second guide roller 42 as a second guide unit for guiding the respective tapes 36 and 37 at a position facing the banknote depositing and dispensing port 35; first and second guide rollers 43 and 44 for guiding the tapes 36 and 37 between the winding reels 38 and 39 and the guide rollers 41 and 42, respectively.

The banknote depositing and dispensing port 35 can receive and feed a banknote 45 transported from and to the transport path 17. When storing the banknote 45, both tapes 36 and 37 are wound around the winding drum 40, and thus the banknote 45 received from the banknote depositing and dispensing port 35 is held between both tapes 36 and 37 for winding and storing. When feeding the banknote 45, both tapes 36 and 37 are unwound from the winding drum 40, and thus the banknote 45 is fed to the banknote depositing and dispensing port 35.

The width of the respective tapes 36 and 37 is set shorter than that in the longitudinal direction of the banknote 45 and approximately one-third of the length in the longitudinal direction of the banknote 45, and formed of, for example, a transparent material. Marks (not shown) are formed at an even interval in the width direction on the one side so that the winding quantity and the unwinding quantity of the respective tapes 36 and 37 can be detected. A first winding quantity detection sensor 47 and a second winding quantity detection sensor 48 as a winding quantity detecting unit for detecting the marks on the respective tapes 36 and 37 and further detecting the winding quantity of the respective tapes 36 and 37 which are wound around the winding drum 40 are disposed between the guide rollers 41 and 42 and between the guide rollers 43 and 44, respectively.

Each of the winding reels 38 and 39 is a flanged reel having a flange on both sides, and attached to the middle portion in the axial direction of respective winding reel axes 50 and 51, rotatably installed between both side plates 31 via respective torque limiters 52 and 53. One end of the respective winding reel axes 50 and 51 is attached to one side plate 31 via a one-way clutch (not shown), and the winding reel axes 50 and 51 are allowed, by the one-way clutch, to rotate only in a direction corresponding to a tape winding direction (clockwise in FIG. 1) of the respective winding reels 38 and 39 when feeding banknotes, and are prevented from rotating in a direction corresponding to a tape unwinding direction (counterclockwise in FIG. 1) of the respective winding reels 38 and 39 when storing banknotes.

The first guide roller 41 and the second guide roller 42 are flanged rollers each having a flange on both sides, and rotatably attached to a first roller axis 55 and a second roller axis 56, respectively. The first roller axis 55 is supported by a bracket 57 attached to the frame 33, and the second roller axis 56 is supported between both side plates 31. The respective tapes 36 and 37 from the respective winding reels 38 and 39 to the winding drum 40 are placed around the guide rollers 41 and 42 so as to face separately from each other, and an approximately triangular space 58 is formed between placing positions of both tapes 36 and 37. The space 58 functions when storing banknotes so that the banknote 45 is received in the space 58 and wound around the winding drum 40 while being held between both tapes 36 and 37. Moreover, the guide rollers 41 and 42 as a guiding unit are not necessarily required to be a roller rotatable with respect to the roller axes 55 and 56, and may be a fixed roller having a small sliding resistance against the tapes 36 and 37 or a fixed member separately provided.

The respective guide rollers 43 and 44 are rotatably attached to the center position in the axial direction of the respective guide roller axes 60 and 61 which are installed between both side plates 31.

The winding drum 40 is attached to a winding drum axis 63 rotatably installed between both side plates 31. The winding drum 40 includes: a tape winding drum unit 64 which is located at the center of the winding drum axis 63 and around which both tapes 36 and 37 are wound; and a pair of banknote winding drum units 65 for winding both side regions in the longitudinal direction of the banknote 45, which is wound in the short-side direction by both tapes 36 and 37 on both sides in the axial direction of the tape winding drum 64.

A pulley 67 (a pulley of the winding reel axis 51 is not shown) having a small diameter is attached to the respective winding reel axes 50 and 51 via a one-way clutch (not shown) outside of one side plate 31, a pulley 68 having a large outer diameter is attached to the winding drum axis 63, further, a driving pulley (not shown) and a plurality of guide pulleys 69 are rotatably provided on the outside of one side plate 31, and an endless driving belt 70 is placed throughout these pulleys 67, 68 and 69. Additionally, a motor 71 for rotating the driving pulley in the forward and reverse direction is attached to the outside of one side plate 31. The respective winding reel axes 50 and 51 constantly rotate faster than the winding drum axis 63 due to a difference in diameter between the pulley 67 of the respective winding reel axes 50 and 51 and the pulley 68 of the winding drum axis 63.

A rotation driving force is transmitted from the pulley 67 to the respective winding reel axes 50 and 51 via the one-way clutch only in a direction corresponding to the tape winding direction (clockwise in FIG. 1) of the respective winding reels 38 and 39 when feeding banknotes, and the winding reel axes rotate in the same direction. The rotation driving force from the pulley 67 is cut off in a direction corresponding to the tape unwinding direction (counterclockwise in FIG. 1) of the respective winding reels 38 and 39 when storing banknotes. When storing banknotes, the respective winding reel axes 50 and 51 are prevented, by the one-way clutch, from rotating in the direction corresponding to the tape unwinding direction of the respective winding reel axes 50 and 51 (counterclockwise in FIG. 1).

At a position of the banknote depositing and dispensing port 35 facing the transport path 17, a pair of transport rollers 75 are disposed as a transport unit for holding and sending the banknote 45, which is transported from the transport path 17, to a space between both tapes 36 and 37 when storing banknotes, and holding and feeding the banknote 45, which is fed from between both tapes 36 and 37 by unwinding from the winding drum 40, to the transport path 17 when feeding banknotes. These transport rollers 75 are attached to the respective roller axes 55 and 56 at both sides of the respective guide rollers 41 and 42, and rotate integrally with the roller axes 55 and 56, respectively.

On the first roller axis 55, first guide levers 77 and 78 are swingably supported for guiding one face of the banknote 45 to be wound and stored around the winding drum 40 or to be unwound and fed at a position of the tape winding drum unit 64 of the winding drum 40 and respective positions of the respective banknote winding drum units 65 of the drum 40.

These first guide levers 77 and 78 follow movably in accordance with an increase or decrease in banknote 45 to be wound around the winding drum 40. A banknote pressing roller 79 for pressing the banknote 45 against the winding drum 40 on both sides of both tapes 36 and 37 is rotatably supported on the center first guide lever 77.

A support axis 81 is rotatably installed at the side position facing the winding drum 40 between both side plates 31, a base end of a swinging lever 82 is attached to the center of the support axis 81, and a contact roller 83 is rotatably attached to a top end of the swinging lever 82 via a contact roller axis 84, the roller 83 being a contact body coming into contact with an outer circumferential face of a portion around which both tapes 36 and 37 are wound to detect the outer diameter of the winding drum 40 around which the banknote 45 is wound. The swinging lever 82 is biased by a biasing unit such as a spring so that the contact roller 83 constantly comes into contact with the outer circumferential face of the winding drum 40. The support axis 81 is arranged at a position so as not to interfere with the outer diameter of the winding drum 40 even when the outer diameter of the winding drum 40 becomes maximum when the maximum quantity of the banknotes 45 are wound around the winding drum 40. An outer diameter detecting unit 85 is constituted for detecting the outer diameter of the winding drum 40 around which the banknote 45 is wound by the swinging lever 82, the contact roller 83, and the biasing unit, etc., that is, for detecting the outer diameter of the portion of the winding drum 40 for winding both tapes 36 and 37 from the state where no banknote 45 is wound to the state where a maximum quantity of the banknotes 45 are wound. Moreover, the contact roller 83 as a contact body is not required to be a roller, and may be a fixed member having a small sliding resistance against the first tape 36. Additionally, the portion of the winding drum 40 winding the banknote 45 the outer diameter of which is detected by the outer diameter detecting unit 85 is not limited to a portion which winds both tapes 36 and 37, and may be a portion which winds the end portion side in the longitudinal direction of the banknote 45 projecting from both tapes 36 and 37. In this case, although the detection accuracy lowers, change in the outer diameter of the winding drum 40 can be detected in accordance with the winding quantity of the banknote 45 wound around the winding drum 40.

A tape pressing body 87 is swingably supported by the second roller axis 56, which is located between the respective winding reels 38 and 39 and the winding drum 40, and presses the first tape 36 from the second tape 37 side so as to bring both tapes 36 and 37 into contact with each other between the respective guide rollers 41,42 and the transport rollers 75, and the winding drum 40. The tape pressing body 87 is formed in an approximate U-shape and includes a swinging member 88 having both ends rotatably supported by the first roller axis 55, and, on a top end of the swinging member 88, a tape pressing roller 89 which comes into contact with and presses the second tape 37 is rotatably supported by a tape pressing roller axis 90. The tape pressing roller 89 is formed so as to have the same width as that of both tapes 36 and 37. Moreover, the tape pressing roller 89 as a tape pressing body 87 is not required to be a roller, and may be a fixed member having a small sliding resistance against the tapes 36 and 37.

A moving unit 92 is provided for moving the tape pressing body 87 in accordance with the outer diameter of the winding drum 40. The moving unit 92 is constituted by an interlocking mechanism 94 in which the contact roller axis 84 of the contact roller 83 and the tape pressing roller axis 90 of the tape pressing roller 89 are linked with each other via a link 93, and makes the tape pressing body 87 move in conjunction with movement of the contact roller 83 in accordance with the outer diameter of the winding drum 40.

To the support axis 81, a second guide lever 96 for guiding both side regions in the longitudinal direction of the other face of a banknote are attached corresponding to respective positions of the banknote winding drum units 65 at both sides of the winding drum. The second guide lever 96 is fixed to the support axis 81 so as to swing integrally with the swinging lever 82.

A banknote detection sensor 98 for detecting the banknote 45 passing for storage or feeding is disposed between the winding drum 40 and both guide rollers 41 and 42.

Next, operation of the banknote storing and feeding unit 19 will be described.

First, operation when storing banknotes will be described.

When the banknote 45 is transported from the transport path 17 to the banknote storing and feeding unit 19, the motor 71 is rotation-driven in a direction corresponding to the banknote storing direction by detecting the banknote 45 by a sensor provided on the transport path 17.

Thus, the winding drum 40 is rotated in the tape winding direction via the driving belt 70 and the pulley 68 to start winding both tapes 36 and 37 around the winding drum 40.

On the other hand, although the respective pulleys 67 also rotate via the driving belt 70, the rotation driving force is not transmitted to the respective winding reel axes 50 and 51 by the one-way clutch, and the respective winding reel axes 50 and 51 do not rotate in a direction corresponding to the tape unwinding direction from the respective winding reels 38 and 39. Since the winding reel axes 50 and 51 are prevented from rotating in the direction corresponding to the tape unwinding direction from the respective winding reels 38 and 39 by the one-way clutch, the winding reels 38 and 39 attached to the respective winding reel axes 50 and 51 via the torque limiters 52 and 53 do not rotate in the unwinding direction, and tension is applied to the respective tapes 36 and 37 to be wound around the winding drum 40.

When the tension applied to the respective tapes 36 and 37 exceeds the set torque value of the torque limiters 52 and 53, the torque limiters 52 and 53 start sliding and the winding reels 38 and 39 rotate in the tape unwinding direction. Accordingly, the respective tapes 36 and 37 are unwound from the winding reels 38 and 39 with a fixed tension applied to the tapes.

When the banknote 45 is transported from the transport path 17 to the banknote depositing and dispensing port 35, a center region in the longitudinal direction of the banknote 45 is held between the pair of transport rollers 75. The pair of transport rollers 75 rotate integrally with the respective guide rollers 41 and 42 rotating with movement of the respective tapes 36 and 37, and send the held banknote 45 to the space between both tapes 36 and 37.

The banknote 45 sent to the space between the both tapes 36 and 37 is held between both tapes 36 and 37 at a position of the tape pressing roller 89 pressing both tapes 36 and 37 so as to bring them into contact with each other, and then wound around the tape winding drum unit 64 of the winding drum 40 together with both tapes 36 and 37 for storing.

Here, one face of both the side regions in the longitudinal direction of the banknote 45 is guided to and pressed against the winding drum 40 by the first guide levers 77 and 78 and the other face thereof is guided to the winding drum 40 by the second guide lever 96, thereby bending or curling is hardly caused to both end regions in the longitudinal direction of the banknote 45 when winding the banknote 45, and the banknote 45 can be smoothly wound and stored.

Further, both tapes 36 and 37 wound around the winding drum 40 are pressed by the contact roller 83 to apply a fastening force to both tapes 36 and 37. Thereby the banknote 45 can be wound and stored at an appropriate fastening force, and a rate of increase in the outer diameter of the winding drum 40 with an increase in the storage quantity of the banknotes 45 can be reduced.

When both tapes 36 and 37 are wound around the winding drum 40, the marks provided at a fixed interval on the respective tapes 36 and 37 are detected by the respective winding quantity detection sensors 47 and 48, and the winding quantity of the respective tapes 36 and 37 to be wound around by the winding drum 40 are detected.

Based on detection of passage of the banknote 45, which is to be wound and stored around the winding drum 40, by a banknote detection sensor 98 and detection of the winding quantity of the respective tapes 36 and 37 by the respective winding quantity detection sensors 47 and 48, the motor 71 is stopped at a predetermined timing that the banknote 45 is wound around the winding drum 40, winding of both tapes 36 and 37 around the winding drum 40 is stopped, and one banknote 45 is completely stored.

Such storing operation is repeated at a predetermined number of times when storing a predetermined number of banknotes 45.

Figure 4:
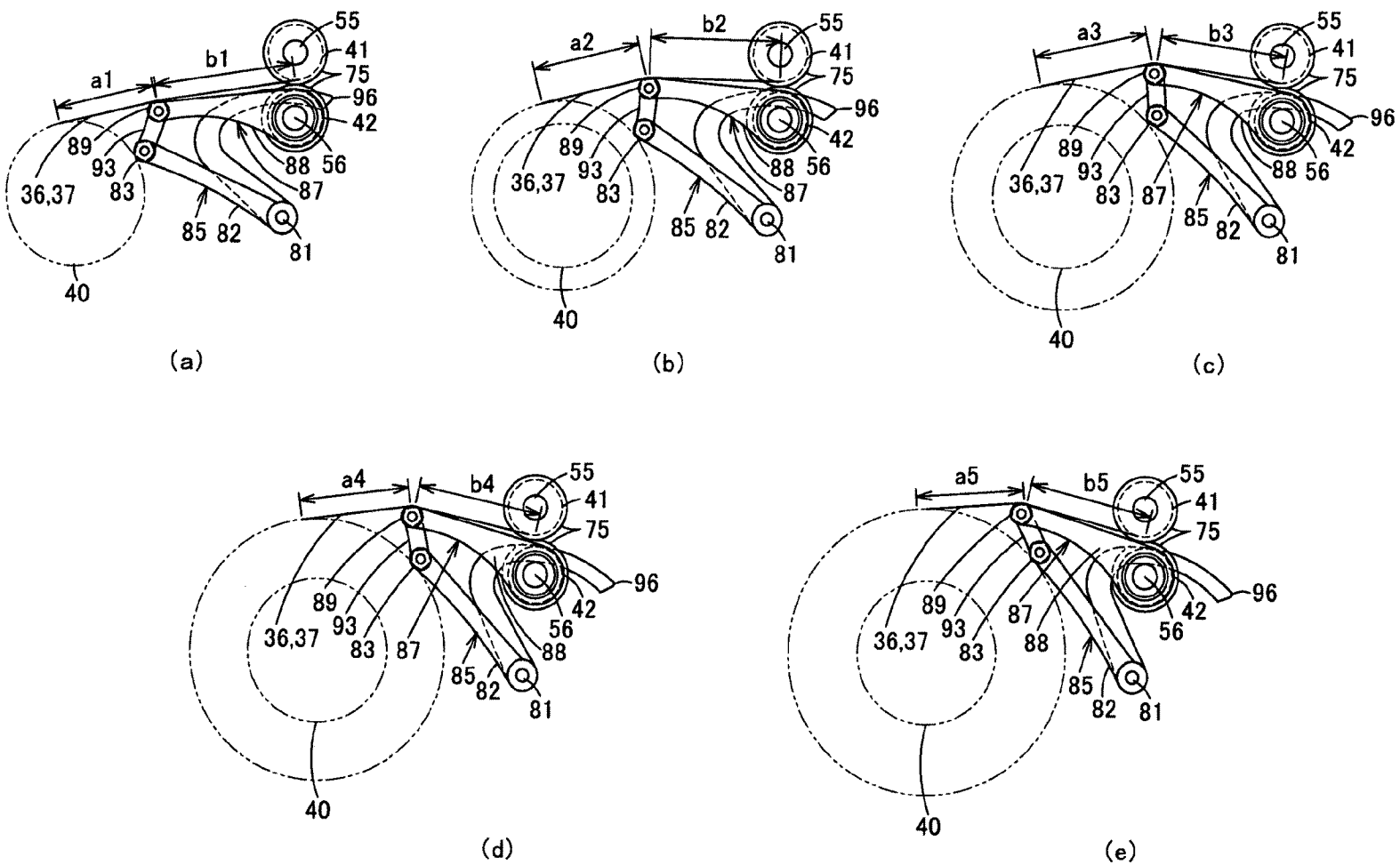
FIG. 4 shows operation of the paper sheet storing and feeding unit in accordance with the storage quantity of paper sheets, FIG. 4(*a*) is an explanatory view of the unit in which no paper sheets are stored, FIG. 4(*b*) is an explanatory view of the unit in which 100 paper sheets are stored, FIG. 4(*c*) is an explanatory view of the unit in which 200 paper sheets are stored, FIG. 4(*d*) is an explanatory view of the unit in which 300 paper sheets are stored, and FIG. 4(*e*) is an explanatory view of the unit in which 400 paper sheets are stored.

FIG. 4(*a*) shows a change in the outer diameter of the portion of the winding drum 40 winding the tape in the state where no banknote 45 is stored, FIG. 4(*b*) shows the change described above in the state where 100 banknotes 45 are stored, FIG. 4(*c*) shows the change described above in the state where 200 banknotes 45 are stored, FIG. 4(*d*) shows the change described above in the state where 300 banknotes 45 are stored, and FIG. 4(*e*) shows the change described above in the state where 400 banknotes 45 are stored.

In the state where no banknote 45 is stored as shown in FIG. 4(*a*), a distance a1 between a tape winding position of the winding drum 40 and a tape contact position of the tape pressing roller 89 and a distance b1 between the tape contact position of the tape pressing roller 89 and a holding position of the pair of transport rollers 75 are shorter than the length in the transporting direction of the banknote 45, respectively (the length in its short-side direction of the banknote 45). Thus, when storing banknotes, a top end in the transporting direction of the banknote 45 reaches the tape contact position of the tape pressing roller 89 and the banknote 45 is held between both tapes 36 and 37 with the banknote 45 held between the pair of transport rollers 75, and the top end in the transporting direction of the banknote 45 reaches the tape winding position of the winding drum 40 with the banknote 45 held between both tapes 36 and 37 at the tape contact position of the tape pressing roller 89, and then the banknote 45 is wound and stored, thereby the banknote 45 sent from the transport path 17 can be transported while being constantly held, and can be stably wound and stored around the winding drum 40.

As the storage quantity of both tapes 36 and 37 and the banknote 45 increases and the outer diameter of the winding drum 40 becomes large, the swinging lever 82 follows and swings in the direction away from the center of the winding drum 40 via the contact roller 83, and the swinging member 88 also follows and swings in the direction away from the center of the winding drum 40 via the link 93.

Although the distance a1 between the tape winding position of the winding drum 40 and the tape contact position of the tape pressing roller 89 changes to distances a2, a3, a4 and a5 in this order by swinging of the swinging member 88, all of the distances a1 to a5 are shorter than the length in the transporting direction of the banknote 45 (the length in its short-side direction of the banknote 45). Additionally, although the distance b1 between the tape contact position of the tape pressing roller 89 and the holding position of the pair of transport rollers 75 changes to distances b2, b3, b4 and b5 in this order, all of the distances b1 to b5 are shorter than the length in the transporting direction of the banknote 45 (the length in its short-side direction of the banknote 45). Thus, even if the outer diameter of the winding drum 40 changes, the banknote 45 sent from the transport path 17 can be transported while being constantly held, and can be stably wound and stored around the winding drum 40.

Moreover, when the quantity of banknotes stored around the winding drum 40 increases, at least either the distance between the tape winding position of the winding drum 40 and the tape contact position of the tape pressing roller 89 or the distance between the tape contact position of the tape pressing roller 89 and the holding position of the pair of transport rollers 75 is sometimes longer than the length in the transporting direction of the banknote 45. However, in this case, for example, the tape pressing roller 89 is added to the swinging member 88 so as to press at two appropriate positions and a part longer than the length in the transporting direction of the banknote 45 is canceled, thereby the banknote 45 can be transported while being constantly held.

Next, operation when feeding banknotes will be described.

The motor 71 is rotation-driven in a direction corresponding to a banknote feeding direction. Thus, the winding drum 40 rotates in a tape unwinding direction via the driving belt 70 and the pulley 68 to start unwinding both tapes 36 and 37 from the winding drum 40.

On the other hand, the respective winding reel axes 50 and 51 rotate in a direction corresponding to the tape winding direction by the winding reels 38 and 39 via the driving belt 70, the respective pulleys 67 and the one-way clutch. Here, the one-way clutch permits the respective winding reel axes 50 and 51 to rotate in the direction corresponding to the tape winding direction by the respective winding reels 38 and 39. The respective winding reels 38 and 39 rotate in the tape winding direction via the torque limiters 52 and 53 by rotation of the respective winding reel axes 50 and 51 to wind the respective tapes 36 and 37 around the winding reels 38 and 39.

Due to a diameter ratio between the pulley 67 of the respective winding reel axes 50 and 51 and the pulley 68 of the winding drum axis 63, the respective winding reels 38 and 39 of the respective winding reel axes 50 and 51 rotate faster than the winding drum 40 of the winding drum axis 63. Thus, regardless of the ratio of the tape winding quantity of the respective winding reels 38 and 39 and the winding drum 40, the tape winding speed of the respective winding reels 38 and 39 becomes higher than the tape unwinding speed from the winding drum 40, and tension is applied to the respective tapes 36 and 37 to be wound around the respective winding reels 38 and 39.

When the tension applied to the tapes 36 and 37 exceeds the set torque value of the respective torque limiters 52 and 53, the torque limiters 52 and 53 start sliding, the respective winding reels 38 and 39 rotate slower than the respective winding reel axes 50 and 51 in the same tape winding direction with a fixed torque applied. Accordingly, the respective tapes 36 and 37 are wound around the respective winding reels 38 and 39 with a fixed tension applied.

By unwinding both tapes 36 and 37 from the winding drum 40, the banknote 45 is unwound together with both tapes 36 and 37. The banknote 45 unwound from the winding drum 40 passes the tape pressing roller 89 pressing both tapes 36 and 37 to bring the tapes into contact with each other, and then is held between the pair of transport rollers 75 and fed to the transport path 17 through the banknote depositing and dispensing port 35 from a space between the pair of transport rollers 75.

Here, both side regions in the longitudinal direction of the banknote 45 fed from the winding drum 40 to the banknote depositing and dispensing port 35 are guided by the first guide levers 77 and 78 and the second guide lever 96, thereby it is difficult to catch both ends in the longitudinal direction of the banknote 45 and the banknote 45 can be smoothly fed.

When only one banknote 45 is fed, passage of the fed banknote 45 is detected by the banknote detection sensor 98, and then the motor 71 is stopped at a predetermined timing to stop unwinding and winding both tapes 36 and 37 from the winding drum 40 and by the winding reels 38 and 39.

When a plurality of banknotes 45 are fed, the motor 71 is continuously driven even after passage of the fed banknote 45 is detected by the banknote detection sensor 98, the motor 71 is stopped at a predetermined timing after passage of a predetermined number of fed banknotes 45 is detected by the banknote detection sensor 98, and the plurality of banknotes 45 are completely fed.

As shown in FIG. 4, by unwinding the tapes 36 and 37 from the winding drum 40, the outer diameter of the winding drum 40 gradually changes to be small. Accordingly, the swinging lever 82 follows and swings in a direction approaching the center of the winding drum 40 via the contact roller 83, and the swinging member 88 also follows and swings in the direction approaching the center of the winding drum 40 via the link 93.

Although the distance between the tape winding position of the winding drum 40 and the tape contact position of the tape pressing roller 89 changes to the distances a5, a4, a3, a2 and a1 in this order by swinging of the swinging member 88, all the distances a5 to a1 are shorter than the length in the transporting direction of the banknote 45 (the length in its short-side direction of the banknote 45). Additionally, although the distance between the tape contact position of the tape pressing roller 89 and the holding position of the pair of transport rollers 75 changes to the distances b5, b4, b3, b2 and b1 in this order, all the distances b5 to blare shorter than the length in the transporting direction of the banknote 45 (the length in its short-side direction of the banknote 45). Thus, even if the outer diameter of the winding drum 40 changes, the fed banknote 45 can be transported while being constantly held, and can be stably fed to the transport path 17.

The first tape 36 and the second tape 37 are thus pressed by the tape pressing body 87, so as to come into contact with each other, between the first and second winding reels 38 and 39 and the winding drum 40, thereby even a banknote 45 having a short length in the transporting direction can be held between the first tape 36 and the second tape 37 at a position of the tape pressing body 87, and reliably transported.

The outer diameter of the winding drum 40 is detected by the contact roller 83 following and moving in accordance with the outer diameter of the winding drum 40 and the tape pressing body 87 is moved via the link 93 of the interlocking mechanism 94 in accordance with the detected outer diameter of the winding drum 40, thereby the tape pressing body 87 can be moved to an appropriate position following a change in the outer diameter of the winding drum 40, and thus the maximum storage quantity of the banknote 45 can be increased and the banknote 45 can be stably stored and fed.

Further, by moving the tape pressing body 87 in accordance with the outer diameter of the winding drum 40, both tapes 36 and 37 can be prevented from largely folding at the position of the tape pressing body 87, so that trouble can be prevented from occurring in the storage state of the banknote 45 when the banknote 45 is wound and stored around the winding drum 40.

Figure 6:
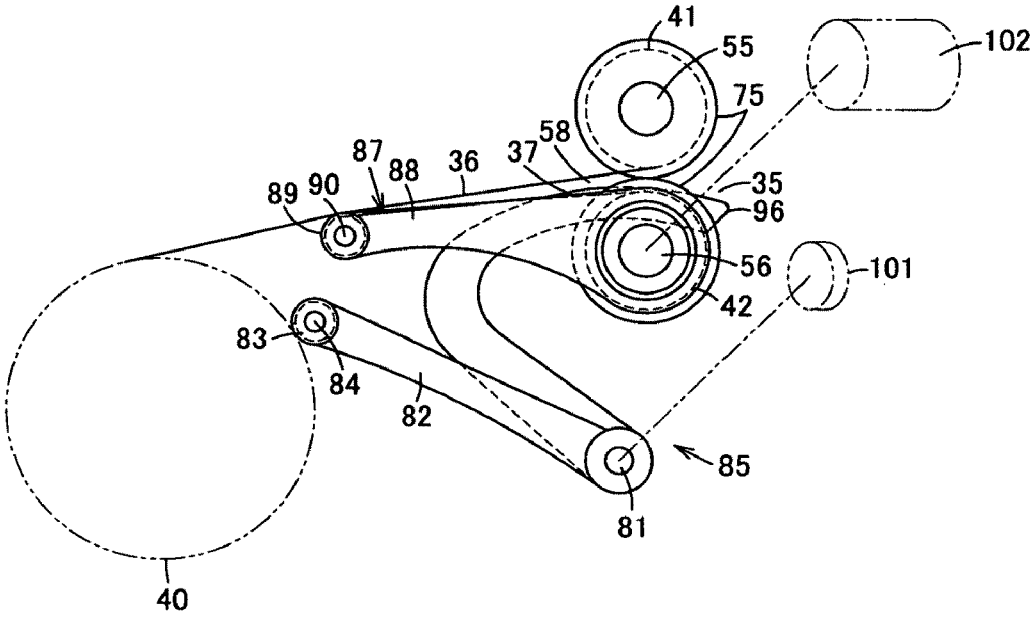
FIG. 6 is an explanatory view of a paper sheet storing and feeding unit of a second embodiment of the present invention.
Figure 7:
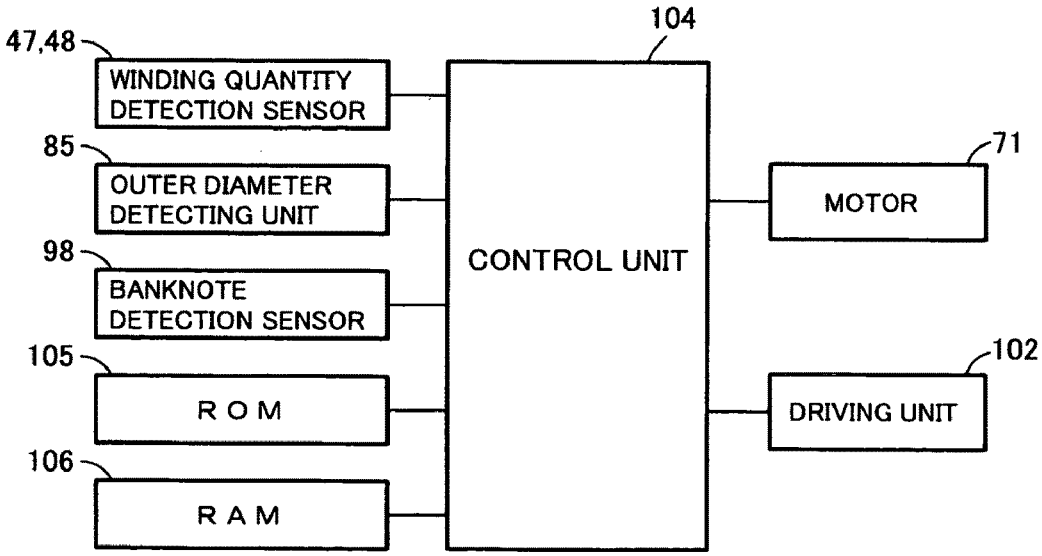
FIG. 7 is a block diagram of the paper sheet storing and feeding unit.

Next, FIGS. 6 and 7 show a second embodiment.

As shown in FIG. 6, the outer diameter detecting unit 85 includes: the support axis 81, the swinging lever 82, the contact roller 83, the contact roller axis 84 and a contact body movement amount detecting unit 101 for detecting the movement amount of the contact roller 83 following and moving in accordance with the outer diameter of the portion of the winding drum 40 around which both tapes 36 and 37 are wound. For example, a potentiometer, rotary encoder or the like for detecting the movement amount of the contact roller 83 based on the rotation amount of the swinging lever 82 around the support axis 81 is used for the contact body movement amount detecting unit 101. Moreover, although the swinging lever 82 here rotationally moves, a supporting system for making the contact roller 83 linearly move may be adopted. In this case, a sensor for detecting the linear movement amount is used.

As the moving unit 92, the interlocking mechanism 94 used in the first embodiment is not used, but a driving unit 102 for moving the tape pressing body 87 in accordance with the movement amount of the contact roller 83 detected by the contact body movement amount detecting unit 101 is used. For example, a stepping motor the rotation position of which can be controlled is used for the driving unit 102, and drives the second roller axis 56. In this case, the pair of transport rollers 75 can be rotated with respect to the second roller axis 56, so that the upper and lower transport rollers 75 integrally rotate being driven by the roller axis 55.

FIG. 7 shows a control unit 104 for controlling the banknote storing and feeding unit 19. The control unit 104 enters detection signals from the winding quantity detection sensors 47 and 48, the outer diameter detecting unit 85 having the contact body movement amount detecting unit 101, the banknote detection sensor 98, etc., to control the motor 71 and the driving unit 102, etc. Moreover, the control unit 104 can communicate with a higher-ranking control unit included in the banknote processing machine 11, or the control unit 104 itself is constituted by the control unit of the banknote processing machine 11. The control unit 104 includes a ROM 105 and RAM 106 for storing programs, various data, etc.

The control unit 104 stores a table defining the outer diameter value of the winding drum 40 corresponding to the movement amount of the contact roller 83 or a relational expression between the movement amount of the contact roller 83 and the outer diameter value of the winding drum 40. Further, the control unit 104 stores a table defining a position of the tape pressing body 87 according to the outer diameter value of the winding drum 40 or a relational expression.

Therefore, the control unit 104 can determine the outer diameter of the winding drum 40 in accordance with the movement amount of the contact roller 83 detected by the contact body movement amount detecting unit 101, controls the driving unit 102 in accordance with the movement amount of the contact roller 83 detected by the contact body movement amount detecting unit 101, and as shown in FIG. 4, swings the tape pressing body 87 in the direction away from the center of the winding drum 40 when the outer diameter of the winding drum 40 is large, and swings the tape pressing body 87 in the direction approaching the center of the winding drum 40 when the outer diameter of the winding drum 40 is small.

As described above, when storing or feeding banknotes, the movement amount of the contact roller 83 following and moving in accordance with the outer diameter of the winding drum 40 is detected by the contact body movement amount detecting unit 101, and the tape pressing body 87 can be moved to an appropriate position by the driving unit 102.

Figure 8:
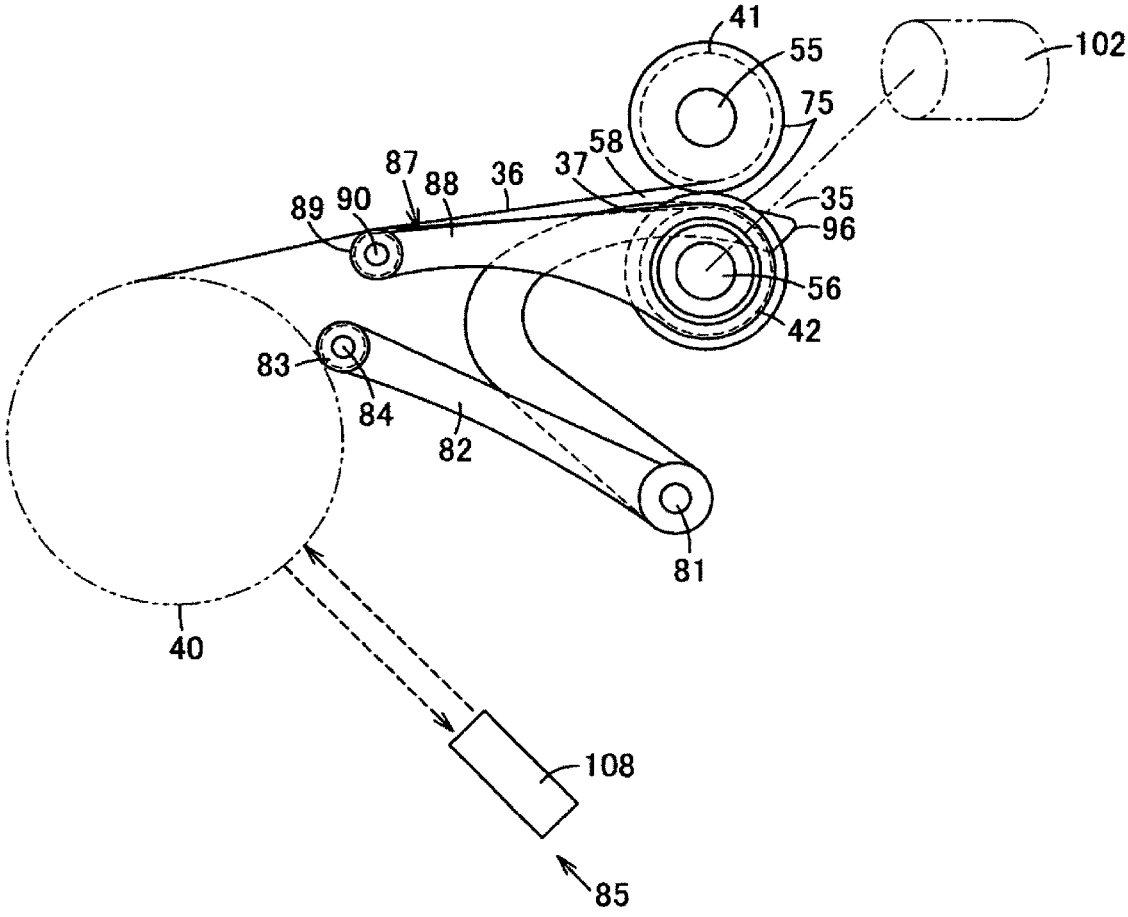
FIG. 8 is an explanatory view of a paper sheet storing and feeding unit of a third embodiment of the present invention.

Next, FIG. 8 shows a third embodiment.

As the outer diameter detecting unit 85 of the second embodiment described above, in place of the contact body movement amount detecting unit 101, a non-contact detection sensor 108 is used which detects, without contact, the outer diameter of the portion of the winding drum 40 around which both tapes 36 and 37 are wound. The non-contact detection sensor 108, for example, irradiates an LED light to the portion of the winding drum 40 around which both tapes 36 and 37 are wound, measures light reflected from there by use of a photodiode to measure a distance between the non-contact detection sensor 108 and the portion of the winding drum 40 around which both tapes 36 and 37 are wound.

Also in this case, the control unit 104 shown in FIG. 7 is used.

The control unit 104 can determine the outer diameter of the winding drum 40 based on the distance between the non-contact detection sensor 108 and the winding drum 40 detected by the non-contact detection sensor 108, controls the driving unit 102 in accordance with the outer diameter of the winding drum 40 detected by the non-contact detection sensor 108, and similar to that shown in FIG. 4, swings the tape pressing body 87 in the direction away from the center of the winding drum 40 when the outer diameter of the winding drum 40 is large, and swings the tape pressing body 87 in the direction approaching the center of the winding drum 40 when the outer diameter of the winding drum 40 is small.

As described above, when storing or feeding banknotes, the outer diameter of the winding drum 40 is thus detected by the non-contact detection sensor 108, thereby the tape pressing body 87 can be moved to an appropriate position by the driving unit 102.

Moreover, the outer diameter detecting unit 85 may be constituted so that the winding quantity of both tapes 36 and 37 wound around the winding drum 40 is detected by both winding quantity detection sensors 47 and 48 to estimate the outer diameter of the portion of the winding drum 40 around which both tapes 36 and 37 are wound based on the winding quantity of both tapes 36 and 37 wound around the winding drum 40. In this case, by detecting the winding quantity of both tapes 36 and 37 around the winding drum 40, the outer diameter of the winding drum 40 is estimated, the driving unit 102 is controlled, and similar to that shown in FIG. 4, the tape pressing body 87 is swung in the direction away from the center of the winding drum 40 when the outer diameter of the winding drum 40 is large, and swung in the direction approaching the center of the winding drum 40 when the outer diameter of the winding drum 40 is small. Additionally, the control unit 104 estimates the outer diameter of the winding drum 40 by use of a table of outer diameter estimation values corresponding to the winding quantity, an approximation expression of a relationship between the winding quantity and the outer diameter estimation value, or the like.

Additionally, the outer diameter detecting unit 85 may be constituted so that the banknote 45 stored or fed is detected by the banknote detection sensor 98 or the transport path 17, thereby the storage number of banknotes 45 wound and stored around the winding drum 40 is counted to estimate the outer diameter of the portion of the winding drum 40 around which both tapes 36 and 37 are wound. In this case, the outer diameter of the winding drum 40 is estimated to control the driving unit 102 by counting the storage number of banknotes 45 wound and stored around the winding drum 40, and similar to that shown in FIG. 4, the tape pressing body 87 is swung in the direction away from the center of the winding drum 40 when the outer diameter of the winding drum 40 is large, and swung in the direction approaching the center of the winding drum 40 when the outer diameter of the winding drum 40 is small. Additionally, the control unit 104 estimates the outer diameter of the winding drum 40 by use of a table of outer diameter estimation values corresponding to the storage numbers, an approximation expression of a relationship between the storage number and the outer diameter estimation value, or the like.

Additionally, the outer diameter detecting unit 85 may be constituted so that the rotation amount of at least either the winding drum 40 and the winding reels 38 and 39 are detected by the rotation amount detecting unit to estimate the outer diameter of the portion of the winding drum 40 around which both tapes 36 and 37 are wound based on the winding quantity of both tapes 36 and 37 wound around the winding drum 40. In this case, by detecting the rotation amount of at least either the winding drum 40 or the winding reel 38 and 39, the outer diameter of the winding drum 40 is estimated to control the driving unit 102, similar to that shown in FIG. 4, the tape pressing body 87 is swung in the direction away from the center of the winding drum 40 when the outer diameter of the winding drum 40 is large, and swung in the direction approaching the center of the winding drum 40 when the outer diameter of the winding drum 40 is small. Additionally, the control unit 104 estimates the outer diameter of the winding drum 40 with use of a table of outer diameter estimation values corresponding to the rotation amounts, an approximation expression of a relationship between the rotation amounts and the outer diameter estimation values, or the like.

Figure 9:
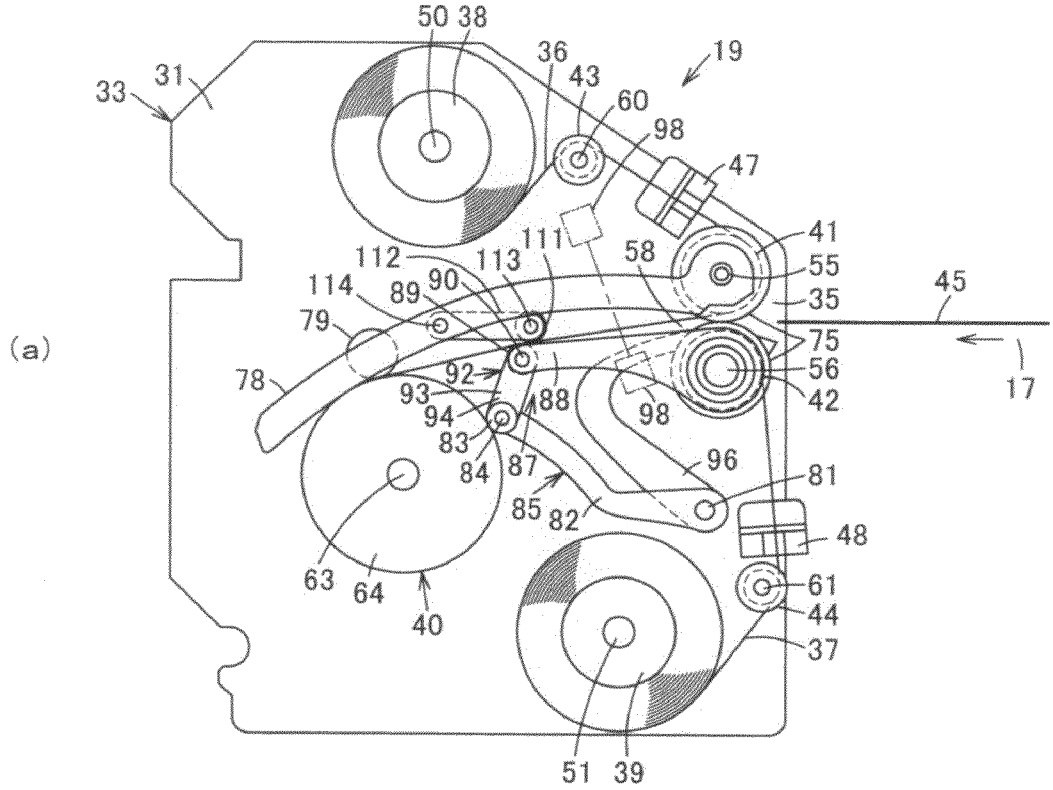
FIG. 9 is a cross sectional view of a paper sheet storing and feeding unit of a fourth embodiment of the present invention, FIG. 9(*a*) is a cross sectional view of the unit in which no paper sheets are stored, and FIG. 9(*b*) is a cross sectional view of the unit in which a maximum storage quantity of paper sheets are stored.
Figure 9:
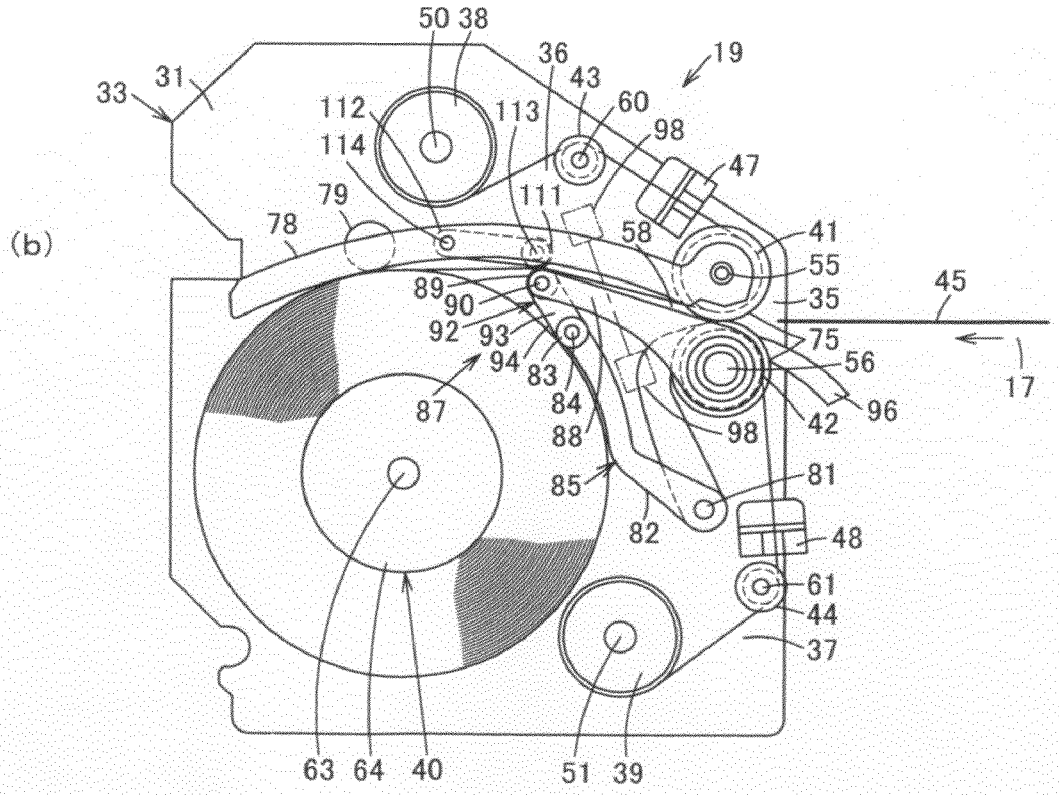

Moreover, in the tape pressing body 87, not only limited to the case where the tape pressing roller 89 pressing from the second tape 37 side to the first tape 36 side so as to bring both tapes 36 and 37 into contact with each other, a pair of tape pressing rollers may be used which may press from the first tape 36 side and hold both tapes 36 and 37 so as to reliably bring both tapes 36 and 37 into contact with each other. Further, like the fourth embodiment shown in FIG. 9, in addition to the tape pressing roller 89 for pressing from the second tape 37 side so as to bring both tapes 36 and 37 into contact with each other (referred to as the first tape pressing roller in the embodiment), the second tape pressing roller 111 for pressing from the first tape 36 side so as to bring both tapes 36 and 37 into contact with each other is added so that both tapes 36 and 37 are held between these, tape pressing rollers 89 and 111 so as to come into contact with each other. The second tape pressing roller 111 is rotatably pivotally supported at a top end of an arm 112 via a axis 113, and a base end of the arm 112 is turnably pivotally supported at the first guide lever 78 via a axis 114. The second tape pressing roller 111 may press both tapes 36 and 37 by deadweight of the second tape pressing roller 111 and deadweight of the arm 112, or may forcibly press both tapes 36 and 37 by a spring arranged between the arm 112 and the first guide lever 78. Even if the first guide lever 78 swings to any place from the state where no banknote 45 is stored as shown in FIG. 9(*a*) to the state where a maximum storage quantity of banknotes 45 are stored as shown in FIG. 9(*b*), the second tape pressing roller 111 constantly presses both tapes 36 and 37 against the first tape pressing roller 89 from the second tape 37 side. Thus, both tapes 36 and 37 can be reliably held between the pair of tape pressing rollers 89 and 111, and the banknote 45 held between the tapes 36 and 37 can be reliably transported.

Additionally, the pair of transport rollers 75 may be provided not only at the positions of the guide rollers 41 and 42 but also at the banknote depositing and dispensing port 35 side or transport path 17 side, and may serve as a transport roller of the transport path 17.

Although the first and second guide rollers 41 and 42 are used as first and second guide units for guiding the first and second tapes 36 and 37 between the first and second winding reels 38 and 39 and the winding drum 40 so that the banknote 45 is transported to the space between both tapes 36 and 37, the guide rollers 41 and 42 may be omitted. The tape pressing roller 89 can be made to serve as a guide roller by, for example, arranging the respective winding reels 38 and 39 in the vicinity of the banknote depositing and dispensing port 35 and directly placing the respective tapes 36 and 37 between the respective winding reels 38 and 39 and the winding reel 40 around the tape pressing roller 89. In this case, a guide member for guiding the banknote 45, which is to be transported to the space between both tapes 36 and 37 and the banknote 45 which is to be fed from between both tapes 36 and 37, between the tape pressing roller 89 and the transport rollers 75 may be provided so as to respond to a change in the outer diameter of the portion of the respective winding reels 38 and 39 around which the respective tapes 36 and 37 are wound. Additionally, only one of the guide rollers 41 and 42 can be omitted.

INDUSTRIAL APPLICABILITY

The present invention is adopted for an escrow unit for escrowing banknotes, a banknote storing unit for storing and feeding banknotes, etc., in a banknote processing unit, and further for a paper sheet processing unit for handling paper sheets such as checks, vouchers and sheets.

The invention claimed is:

1. A paper sheet storing and feeding unit for storing transported paper sheets and feeding stored paper sheets outward, including:

a first tape;

a second tape;

a first winding reel to which one end of the first tape is attached and around which the first tape is wound and unwound;

a second winding reel to which one end of the second tape is attached and around which the second tape is wound and unwound;

a winding drum, to which other ends of the first and second tapes are attached so that at least a part of the first tape and a part of the second tape are overlapped when the first and second tapes are wound, and around which the first and second tapes and a paper sheet held between the first and second tapes are wound and unwound;

a tape pressing body which is arranged between the first and second winding reels and the winding drum and presses the first and second tapes at least one place so as to bring the first and second tapes into contact with each other between the respective first and second winding reels and the winding drum;

an outer diameter detecting unit for detecting an outer diameter of the winding drum around which the paper sheet is wound; and a moving unit for moving the tape pressing body in accordance with the outer diameter of the winding drum detected by the outer diameter detecting unit.

2. The paper sheet storing and feeding unit according to claim 1, including at least one of the following guide units:

a first guide unit which is pressed against the first tape between the tape pressing body and the first winding reel to guide the first tape so that the paper sheet is transported to a space between the first tape and the second tape; and a second guide unit which is pressed against the second tape between the tape pressing body and the second winding reel to guide the second tape so that the paper sheet is transported to the space between the first tape and the second tape.

3. The paper sheet storing and feeding unit according to claim 1, wherein the outer diameter detecting unit includes a contact body which comes into contact with an outer circumferential face of the winding drum around which the paper sheet is wound and follows and moves in accordance with an outer diameter of the winding drum, and the moving unit includes an interlocking mechanism which moves the tape pressing body in accordance with movement of the contact body.

4. The paper sheet storing and feeding unit according to claim 1, wherein the moving unit includes a driving unit for moving the tape pressing body in accordance with an outer diameter of the winding drum detected by the outer diameter detecting unit.

5. The paper sheet storing and feeding unit according to claim 1, wherein the outer diameter detecting unit includes: a contact body which comes into contact with the outer circumferential face of the winding drum around which the paper sheet is wound and follows and moves in accordance with the outer diameter of the winding drum; and a contact body movement amount detecting unit for detecting a movement amount of the contact body, and the moving unit includes a driving unit for moving the tape pressing body in accordance with the movement amount of the contact body detected by the contact body movement amount detecting unit.

6. The paper sheet storing and feeding unit according to claim 1, wherein the outer diameter detecting unit includes a non-contact detection sensor for detecting, without contact, the outer diameter of the winding drum around which the paper sheet is wound, and the moving unit includes a driving unit for moving the tape pressing body in accordance with the outer diameter of the winding drum detected by the non-contact detection sensor.

7. The paper sheet storing and feeding unit according to claim 1, wherein the outer diameter detecting unit detects a winding quantity of the first and second tapes which are wound around the winding drum, and the moving unit includes a driving unit for moving the tape pressing body in accordance with the winding quantity of the first and second tapes which are wound around the winding drum detected by the outer diameter detecting unit.

8. The paper sheet storing and feeding unit according to claim 1, wherein the outer diameter detecting unit counts the storage number of paper sheets wound and stored around the winding drum, and the moving unit includes a driving unit for moving the tape pressing body in accordance with the storage number of paper sheets counted by the outer diameter detecting unit.

9. The paper sheet storing and feeding unit according to claim 1, wherein the outer diameter detecting unit detects the rotation amount of at least either the winding drum or the winding reel, and the moving unit includes a driving unit for moving the tape pressing body in accordance with the rotation amount of at least either the winding drum or the winding reel detected by the outer diameter detecting unit.

* * * * *